US007730671B2

(12) United States Patent
Zab et al.

(10) Patent No.: US 7,730,671 B2
(45) Date of Patent: Jun. 8, 2010

(54) SLIDING LOUVERED DOORS

(76) Inventors: Andy Zab, 104 Melrose Street, Toronto, Ontario (CA) M8Y 1B3; Effie Zab, 104 Melrose Street, Toronto, Ontario (CA) M8Y 1B3

( * ) Notice: Subject to any disclaimer, the term of this patent is extended or adjusted under 35 U.S.C. 154(b) by 920 days.

(21) Appl. No.: 11/410,108

(22) Filed: Apr. 25, 2006

(65) Prior Publication Data

US 2007/0245633 A1 Oct. 25, 2007

(51) Int. Cl.
*E05D 13/00* (2006.01)

(52) U.S. Cl. ..... 49/409; 49/64

(58) Field of Classification Search ..... 49/61, 49/63, 64, 409, 410; 52/204.51
See application file for complete search history.

(56) References Cited

U.S. PATENT DOCUMENTS 1,238,703 A * 8/1917 Wendelken ..... 160/103
1,344,529 A * 6/1920 White ..... 49/63
1,781,304 A * 11/1930 Shook ..... 49/64
2,317,994 A * 5/1943 Huff ..... 160/103
2,957,211 A * 10/1960 Howard ..... 49/95
3,452,477 A * 7/1969 Sassano ..... 49/116
4,254,581 A * 3/1981 Ishihara ..... 49/82.1
4,457,106 A * 7/1984 Forquer ..... 49/158
5,524,390 A * 6/1996 Christensen ..... 49/463
5,893,242 A * 4/1999 Perron ..... 52/202
6,213,187 B1 * 4/2001 Hughes ..... 160/90
6,658,793 B2 * 12/2003 Perron ..... 49/123
7,128,120 B2 * 10/2006 Orbeck et al. ..... 160/89

* cited by examiner

*Primary Examiner*—Jerry Redman
(74) *Attorney, Agent, or Firm*—Elias Borges

(57) ABSTRACT

The present invention is a pair of sliding louvered doors consisting of first and second louvered doors. Each of the louvered doors has a frame consisting of a pair of vertical stiles, each stile having a front face and a rear face and a plurality of louvers mounted between the stiles. The doors are mounted to an elongated head member having two parallel support tracks, each louvered door being suspended on a different track such that the first louvered door is mounted parallel to and in front of the second louvered door. The two louvered doors are separated from each other by a distance such that the rear face of the stiles of the first door faces the front face of the stiles of the second door. The louvers of the first door are mounted to the stiles of the first door such that a portion of the louvers extend beyond the front face of the stiles and the louvers do not extend substantially beyond the rear face of the stiles. Finally, the louvers of the second door are mounted to the stiles of the second door such that a portion of the louvers extend beyond the rear face of the stiles and the louvers do not extend substantially beyond the front face of the stiles of the second door.

15 Claims, 6 Drawing Sheets

SLIDING LOUVERED DOORS

FIELD OF THE INVENTION

The invention relates generally to sliding doors having movable louvers.

BACKGROUND OF THE INVENTION

Sliding louvered doors are an alternative to louvered bi-folding shutters. Sliding louvered doors are often mounted in front of sliding glass doors. Sliding glass doors have an operational door and a stationary door. The operational door has a handle which varies with each manufacturer and presents a technical glitch to interior shutter door applications. Sliding louvered doors generally consist of a three piece frame (post and lintel construction method), supporting a pair of louvered sliding doors or a pair of bi-folding louvered shutters. In this type of construction the lintel must be supported by two vertical posts. The size (depth) of the vertical posts is determined by the handle protrusion. In order for the louvers to be opened or closed the shutter or louvered door must be positioned forward from the handle of the glass sliding doors a distance determined by the type of louver. These technicalities caused the standard 5', 6', 8' sliding patio shutter doors and frames to be customized due to complex details arising from the different patio door handles and their inconsistent installation patterns. In order to permit the doors to slide past each other, the two doors are mounted parallel to each other and the two doors 20 are separated by a distance. The installation of plastic nylon guides on the floor provides directional guidance.

Another problem with the previous louvered sliding door designs is that the louvers had to be in the closed position to ensure that the doors can slide past each other without hitting or the doors had to be spaced far apart from each other to ensure the louvers do not hit the louvers of the other door. Also, previous applications of louvered shutters required a pair of bi-folding shutters due to louver length limits. Present manufacturing methods of drilling standard 1 ⅜" and 2" stiles in the center creates the limitations above. The combined limitations above and their complexity held back the popularity of previous louvered sliding door designs.

SUMMARY OF THE INVENTION

In accordance with the present invention, there is provided a pair of sliding louvered doors consisting of first and second louvered doors. Each of the louvered doors has a frame consisting of a pair of vertical stiles, each stile having a front face and a rear face and a plurality of louvers mounted between the stiles. The doors are mounted to an elongated head member having two parallel support tracks, each louvered door being suspended on a different track such that the first louvered door is mounted parallel to and in front of the second louvered door. The two louvered doors are separated from each other by a distance such that the rear face of the stiles of the first door faces the front face of the stiles of the second door. The louvers of the first door are mounted to the stiles of the first door such that a portion of the louvers extend beyond the front face of the stiles and the louvers do not extend substantially beyond the rear face of the stiles. Finally, the louvers of the second door are mounted to the stiles of the second door such that a portion of the louvers extend beyond the rear face of the stiles and the louvers do not extend substantially beyond the front face of the stiles of the second door.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
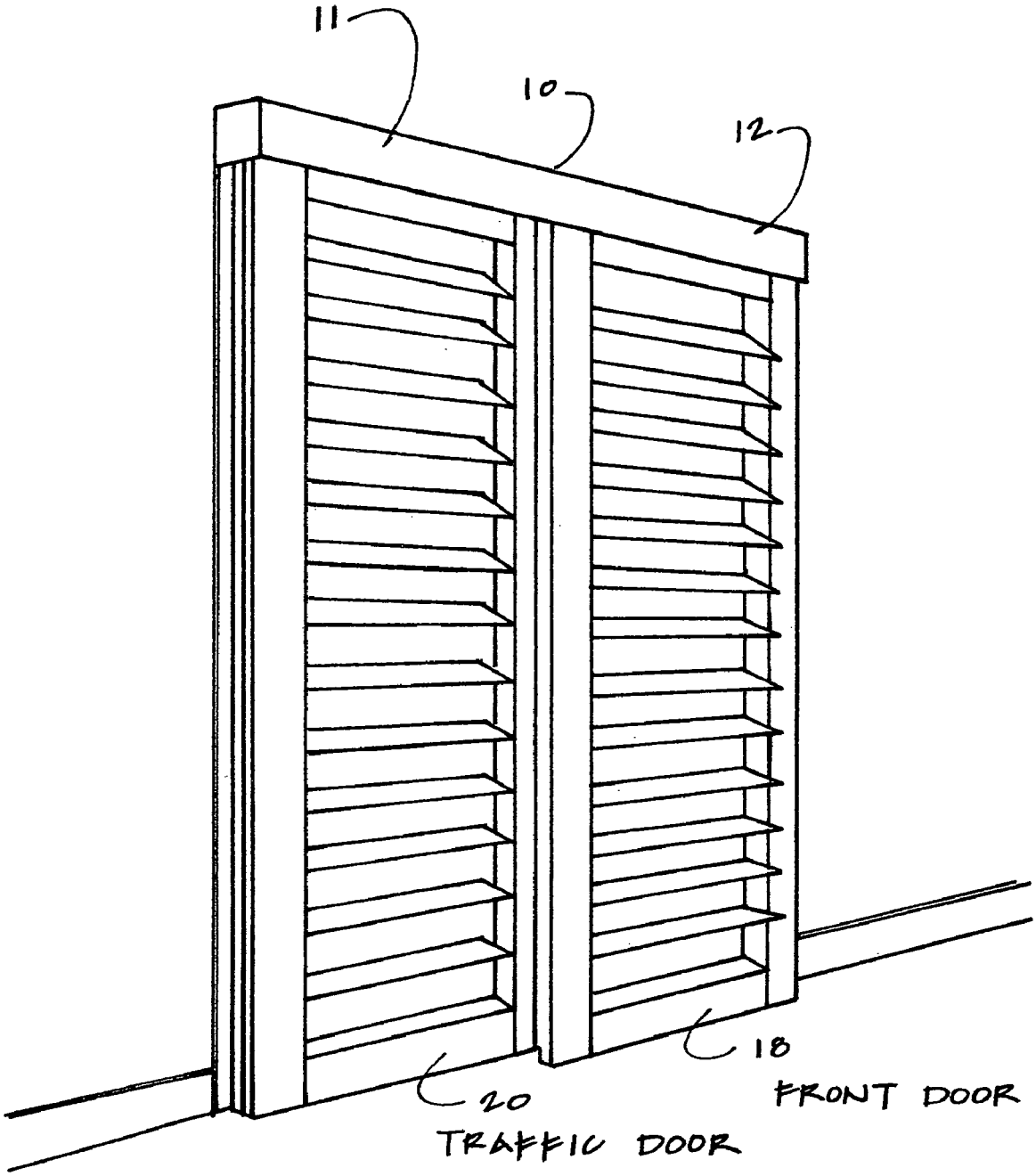
FIG. 1. is a front view of a louvered sliding door made in accordance with the present invention.

Referring firstly to FIG. 1, sliding louvered doors made in accordance with the present are shown generally as item 10 and consist of a pair of louvered sliding doors 18 (the front door) and 20 (the traffic door) mounted to a suspension frame 11. Frame 11 consists of an elongated head member 12 mounted which is anchored to the lintel of the existing patio door frame. Louvered doors 18 and 20 are preferably mounted directly to head member 12 by suspension rails (not shown) of the type generally used to hang sliding doors.

Figure 2:
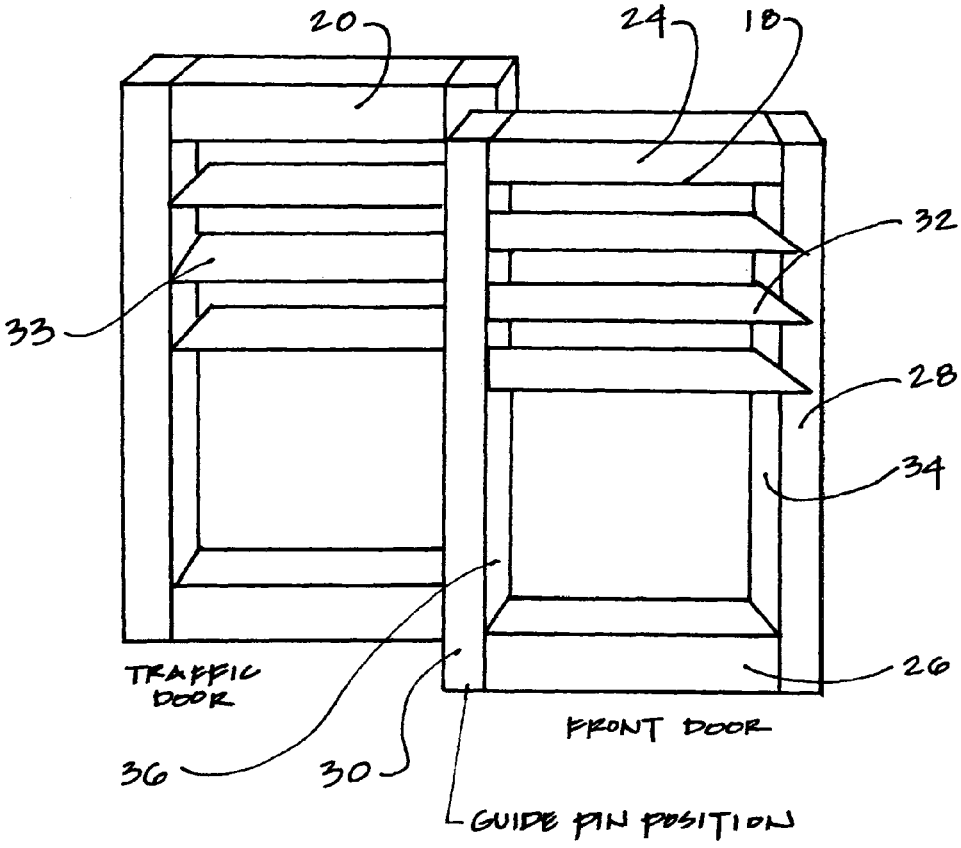
FIG. 2. is a front perspective view of a pair of louvered sliding doors made in accordance with the present invention.
Figure 3:
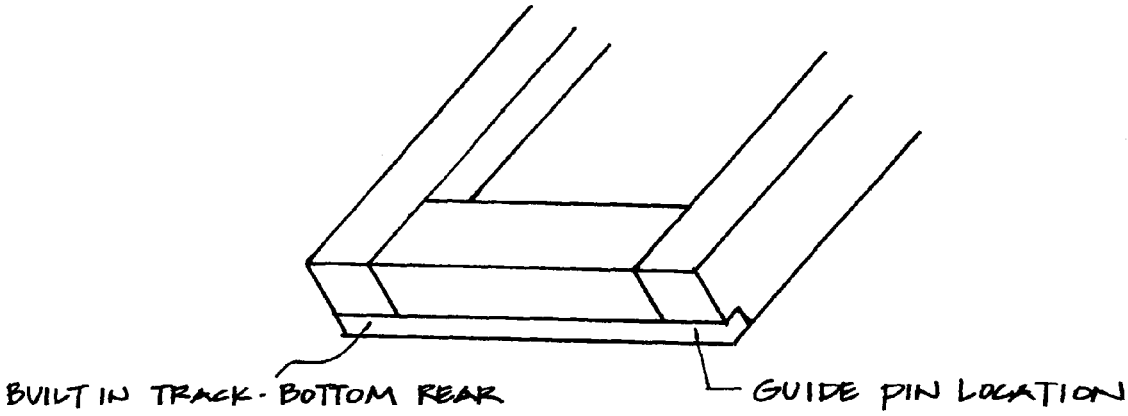
FIG. 3. is a bottom perspective view of the underside of a louvered sliding door made in accordance with the present invention.
Figure 7:
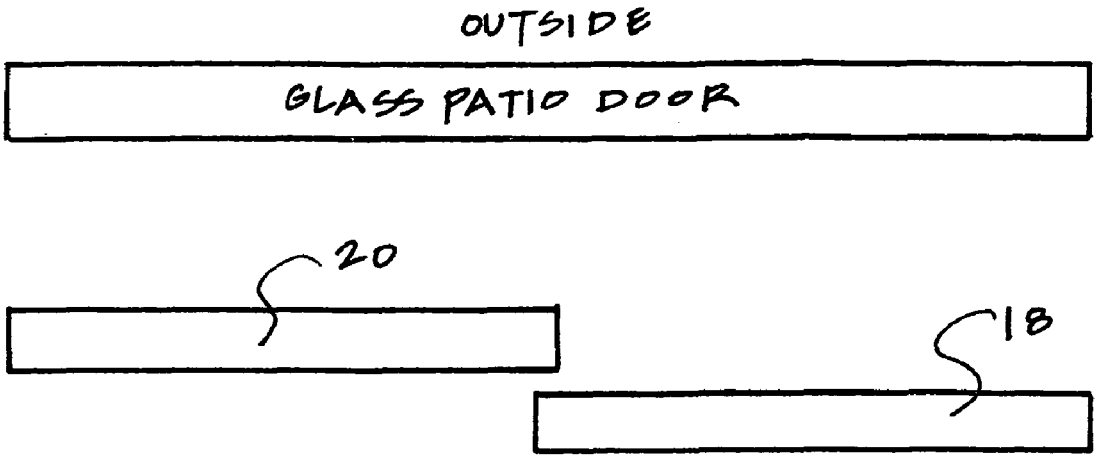
FIG. 7 is a top view of the louvered sliding doors shown in FIG. 2.
Figure 8:
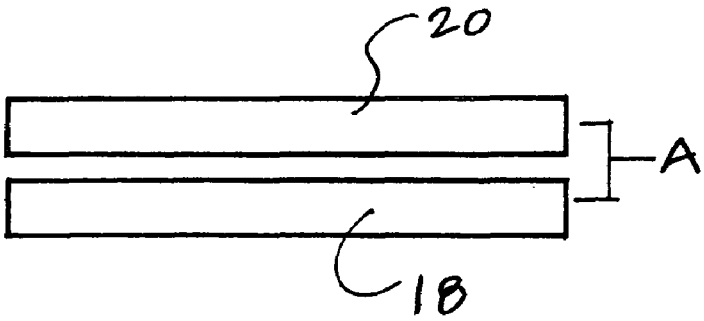
FIG. 8 is a top view of the louvered sliding doors shown in FIG. 2 showing the doors moved towards each other.

Referring now to FIG. 2, sliding louvered doors 18 and 20 each consist of a series of louvers mounted within a frame. Louvered door 18 has frame 22 consisting of top frame member or rail 24 and bottom frame member or rail 26 mounted between vertical frame members (stiles) 28 and 30. Stiles members 28 and 30 have inside walls 34 and 36 respectively. Louvers 32 are mounted to vertical stiles 28 and 30 between inside walls 34 and 36, respectively. The louvers are mounted in parallel spaced apart arrangement with the distance between the louvers being constant. Preferably, the louvers are either 2 inches or 3 inches apart. As better seen in FIGS. 7 and 8, door 20 is mounted behind door 18 and the two doors are separated by a distance A which is selected to be sufficient to permit the two doors to slide past each other without touching.

Figure 4:
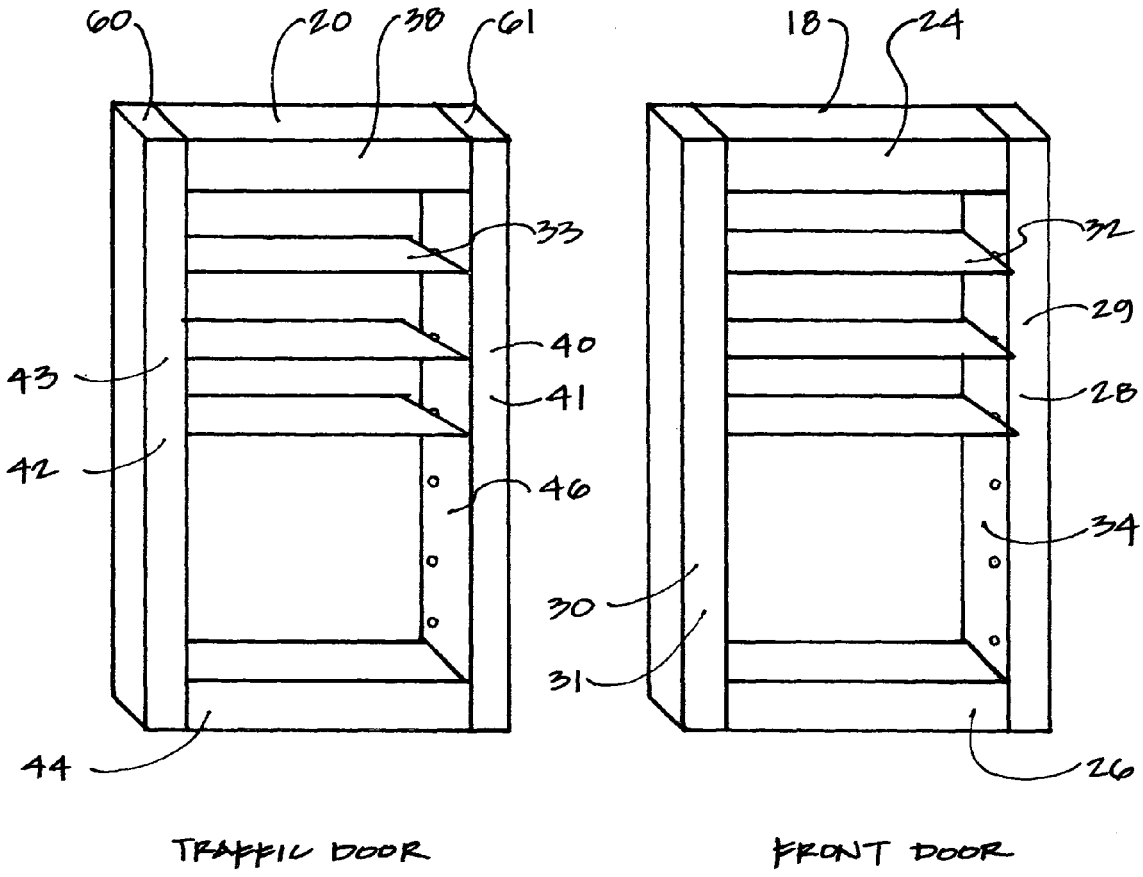
FIG. 4 is a front perspective view of a pair of louvered sliding doors made in accordance with the present invention.
Figure 5:
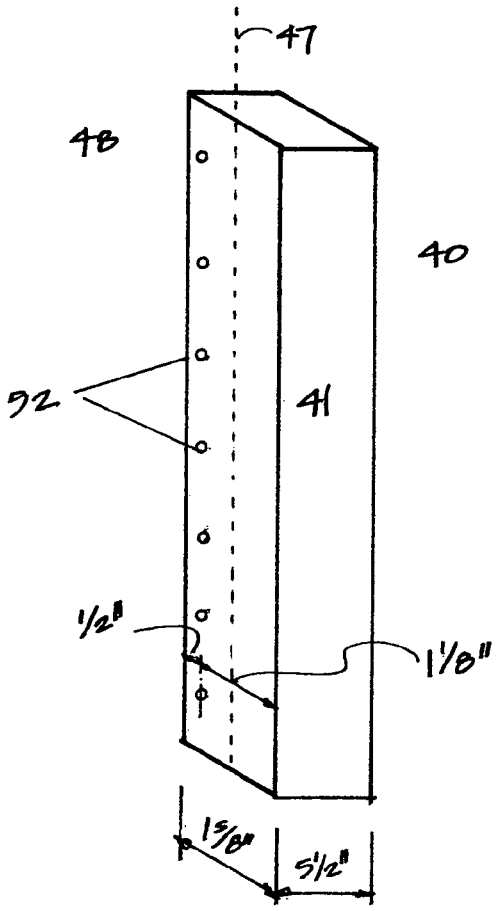
FIG. 5 is a front perspective view of one of the stiles of one of the louvered sliding doors shown in FIG. 4.
Figure 6:
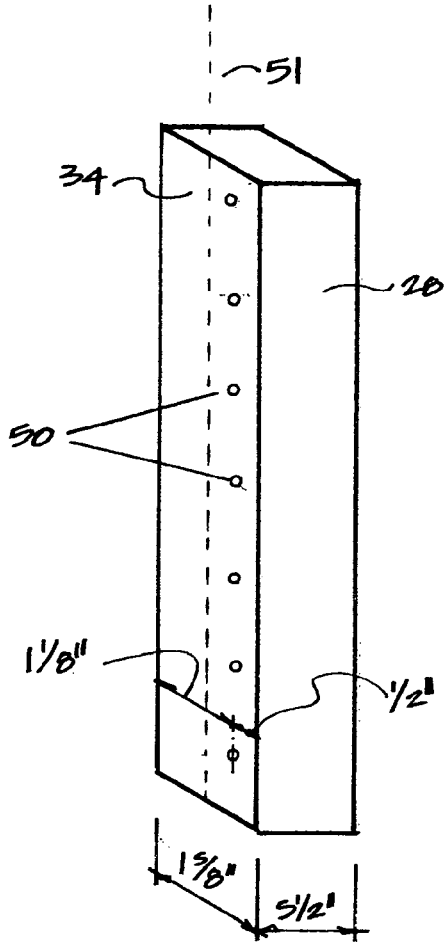
FIG. 6 is a front perspective view of one of the stiles of one of the louvered sliding doors shown in FIG. 4.

Referring now to FIGS. 4, 5 and 6, the louvers forming each door are pivotally attached to stiles forming the door's frame. Vertical stiles 28 and 30 of door 18 (the front door) are provided with a row of louver mounting apertures 50. As best seen in FIG. 6, apertures 50 are formed on inner wall 34 of stile 28 to one side of central axis 51. Preferably, apertures 50 are approximately ½ inch from front face 29 of vertical stile 28. It will be appreciated that vertical stile 30 also has a corresponding row of louver mounting apertures (not shown) which are preferably approximately ½ inch from front face 31 of the vertical stile. For door 20 (the traffic door), louvers 33 are mounted between vertical stiles 40 and 42 which are held together by top frame member 38 and lower frame element 44. As seen in FIG. 5, vertical stile 40 has a plurality of louver mounting apertures 52 located to one side of vertical axis 47. Preferably, mounting apertures 52 are approximately 1 ⅝ inches from front face 41 of the vertical stile 40. Likewise, vertical stile 42 also has a corresponding row of louver mounting apertures (not shown) spaced away from front face 43 of the support member. Preferably, the row of louver mounting apertures is approximately 1 ⅝ inches from front face 43 of vertical stile 42.

Figure 9:
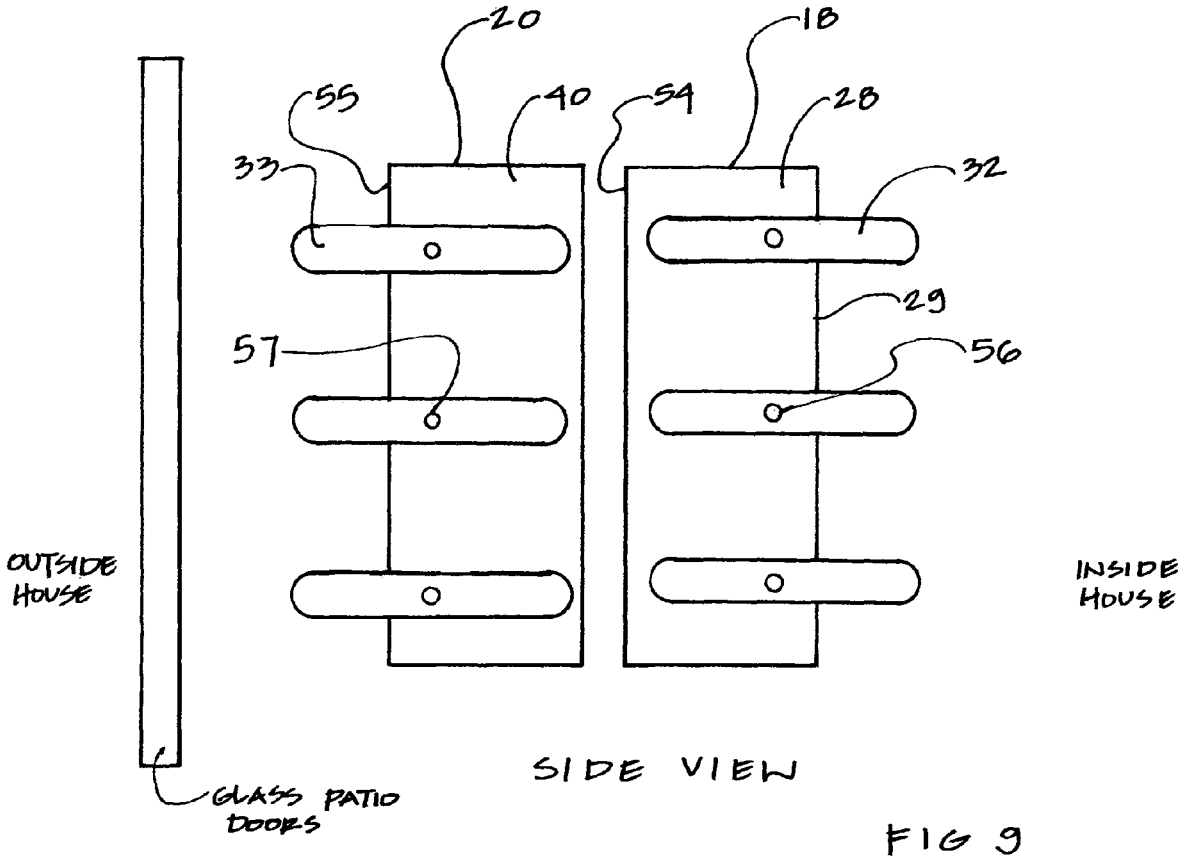
FIG. 9 is a sectional side view of the louvered doors shown in FIG. 8.

As can best be seen in FIG. 9, louvers 32 and 33 are asymmetrically mounted within the stiles of doors 18 and 20 such that a portion of the louvers extend beyond the stiles. For example, louvers 32 are mounted to stile 28 at central pivot 56 towards front face 29 such that a portion of the louvers extend beyond the front face of the stile. Since louvers 32 are asymmetrically mounted to the stiles of door 18, the louvers do not extend past rear face 54 of the stiles. However, louvers 33 are mounted within the stiles of door 20 such that a portion of the louvers extend beyond rear face 55 of the stiles and the louvers do not extend past front face 41 of the stiles. Therefore, in this arrangement, rear face 54 of door 18 and front face 41 or door 20 may be brought very close together and the doors may still slide past each other without the louvers interfering with the movement of the doors. The asymmetric mounting of the louvers in the door frames permits the use of relatively wide louvers without causing the louvers to interfere with the operation of the doors. To ensure that the louvers are well balanced and do not tend to open or close due to the action of gravity, louvers 32 and 33 are preferably mounted at points 56 and 57, respectively, in the very center of the end of the louvers. This not only permits the louvers to remain balanced, but also tends to make the louvers look better. In addition, the central portion of the louvers is often the thickest and strongest, therefore, mounting the louvers at the center makes for a more secure connection.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A pair of sliding louvered doors comprising a a first and second louvered door, each louvered door having a frame comprising a pair of stiles, each stile having a front face and a rear face and a plurality of louvers mounted between the stiles;

b an elongated head member having two parallel support tracks, the louvered doors being suspended on the tracks such that the first louvered door is mounted parallel to and in front of the second louvered door, the two louvered doors being separated from each other by a distance such that the rear face of the stile of the first door faces the front face of the stile of the second door;

c the louvers of the first door being mounted to the stiles of the first door such that a portion of the louvers extend beyond the front face of the stiles and the louvers do not extend beyond the rear face of the stiles, and d the louvers of the second door being mounted to the stiles of the second door such that a portion of the louvers extend beyond the rear face of the stiles and the louvers do not extend beyond the front face of the stiles of the second door.

2. The louvered doors of claim 1 wherein the frames of the louvered doors include a bottom rail, the bottom rail having an elongated channel extending along the bottom rail, the channel being dimensioned to receive a guide pin.

3. The louvered doors of claim 1 wherein the head member is mounted in a cantilever fashion.

4. The louvered doors of claim 1 wherein the louvers of each door have opposite ends, the louvers being pivotally mounted to the stiles at the opposite ends of the louvers at a central point on the end of each louver, the central point being positioned substantially at the center of the louver end.

5. The louvered doors of claim 4 wherein the stiles each have a central vertical axis and wherein the louvers are mounted to the stiles on one side of the vertical axis.

6. The louvered doors of claim 5 wherein the louvers of the first door are mounted to the stiles at a point between the central vertical axis of the stiles and the front face of the stiles.

7. The louvered doors of claim 5 wherein the louvers of the second door are mounted to the stiles at a point between the central vertical axis of the stiles and the back face of the stiles.

8. The louvered doors of claim 7 wherein the louvers of the first door are mounted to the stiles at a point between the central vertical axis of the stiles and the front face of the stiles.

9. A pair of sliding louvered doors for mounting in front of a sliding patio door having a door frame, the louvered doors comprising:

a a first and second louvered door, each louvered door having a louver door frame comprising a pair of stiles, each stile having a front face and a rear face and a plurality of louvers mounted between the stiles;

b an elongated head member mounted to the door frame, the head member having two parallel support tracks, the louvered doors being suspended on the tracks such that the first louvered door is mounted parallel to and in front of the second louvered door, the two louvered doors being separated from each other by a distance such that the rear face of the stile of the first door faces the front face of the stile of the second door;

c the louvers of the first door being mounted to the stiles of the first door such that a portion of the louvers extend beyond the front face of the stiles and the louvers do not extend beyond the rear face of the stiles, and d the louvers of the second door being mounted to the stiles of the second door such that a portion of the louvers extend beyond the rear face of the stiles and the louvers do not extend beyond the front face of the stiles of the second door.

10. The sliding louvered doors of claim 9 wherein the head rail is mounted to the door frame in a cantilever fashion.

11. The louvered doors of claim 9 wherein the louvers of each door have opposite ends, the louvers being pivotally mounted to the stiles at the opposite ends of the louvers at a central point on the end of each louver, the central point being positioned substantially at the center of the louver end.

12. The louvered doors of claim 9 wherein the stiles each have a central vertical axis and wherein the louvers are mounted to the stiles on one side of the vertical axis.

13. The louvered doors of claim 12 wherein the louvers of the first door are mounted to the stiles at a point between the central vertical axis of the stiles and the front face of the stiles.

14. The louvered doors of claim 12 wherein the louvers of the second door are mounted to the stiles at a point between the central vertical axis of the stiles and the back face of the stiles.

15. The louvered doors of claim 14 wherein the louvers of the first door are mounted to the stiles at a point between the central vertical axis of the stiles and the front face of the stiles.

* * * * *